United States Patent [19]

Berry et al.

[11] 4,435,035

[45] Mar. 6, 1984

[54] MASS TERMINATABLE SINGLE ROW CONNECTOR ASSEMBLY

[75] Inventors: Donald A. Berry, Elizabethtown; David J. Fabian, Harrisburg; John E. Lucius, Enola, all of Pa.

[73] Assignee: AMP Incorporated, Harrisburg, Pa.

[21] Appl. No.: 249,541

[22] Filed: Mar. 31, 1981

[51] Int. Cl.[3] ..... H01R 13/514

[52] U.S. Cl. ..... 339/99 R; 339/208

[58] Field of Search ..... 339/97 R, 97 P, 98, 339/99, 258 R, 258 P, 206–207, 208, 210

[56] References Cited

U.S. PATENT DOCUMENTS

| | | | |
|---|---|---|---|
| 3,363,224 | 1/1968 | Gluntz | 339/258 |
| 3,877,771 | 4/1975 | Jensen et al. | 339/99 R X |
| 4,243,288 | 1/1981 | Lucius et al. | 339/99 R |
| 4,296,988 | 10/1981 | Warner | 339/97 R |
| 4,350,404 | 9/1982 | Clark et al. | 339/99 R X |

*Primary Examiner*—Mark Rosenbaum
*Assistant Examiner*—Timothy V. Eley
*Attorney, Agent, or Firm*—Russell J. Egan

[57] ABSTRACT

A connector assembly is disclosed for effecting mass insulation displacing termination of a plurality of conductors into a like plurality of terminals which are preloaded into a housing in a single aligned row. The subject connector assembly includes a housing having a plurality of terminal passages therein opening, in a forward direction, onto a mating face normal to the axes of the passages and, in a rearward direction, opening outwardly toward one side of the housing. A terminal is mounted in each passageway with a matable portion directed toward the mating face and an insulation displacing, conductor engaging portion lying in the outwardly open rear portion. The subject connector assembly also has a cover with one end edge engageable with the housing at the outward opening of the passageways and the other end enclosing the rear of the housing.

8 Claims, 7 Drawing Figures

MASS TERMINATABLE SINGLE ROW CONNECTOR ASSEMBLY

BACKGROUND OF THE INVENTION

1. The Field Of The Invention

The present invention relates to a connector assembly and in particular to a housing pre-loaded with terminals which can be utilized for effecting mass termination of multiple conductors.

2. The Prior Art

The present invention constitutes an improvement over the connector assembly described in U.S. Pat. No. 4,243,288, the disclosure of which is incorporated herein by reference. The connector disclosed in that patent provides many advantages over the known prior art but it does have a disadvantage in that it is a double row connector.

SUMMARY OF THE INVENTION

The present invention provides a connector assembly for intermating with a single row of terminals. The subject invention has a housing of rigid insulative material with plurality passages in an aligned single row opening onto a front mating face. Each passage has a rear portion that is opened to the side of the housing. An electrical terminal is provided in each passage, each terminal having a mating portion lying in the enclosed front portion of the rspective passage and an insulation displacing, conductor engaging portion lying in the open rear portion. A cover completes the assembly and is engageable with the housing, at the intersection of the open and closed portions of the passageways and encloses the rear of the housing.

It is therefore an object of the present invention to produce an improved electrical connector assembly which will provide a cost efficient mass termination of multiple conductors in a single operation.

It is another object of the present invention to produce an improved electrical connector assembly utilizing pre-loaded and partly exposed insulation displacing terminals with a cover enclosing the terminals after termination is effected.

It is a further object of the present invention to produce a connector assembly which is fully serviceable.

It is yet a further object of the present invention to produce an electrical connector assembly which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
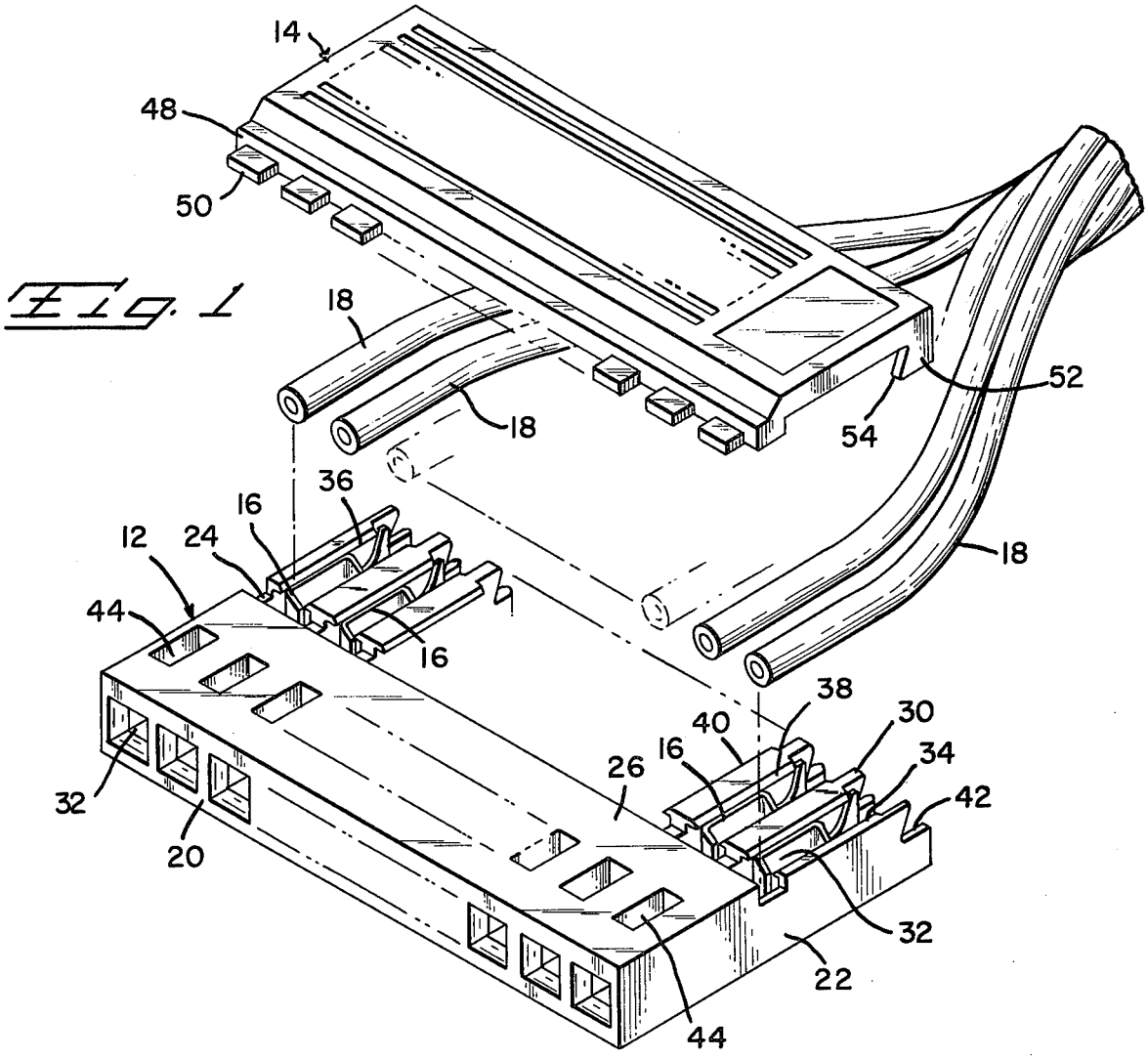
FIG. 1 is an exploded perspective view of an electrical connector according to the present invention.
Figure 2:
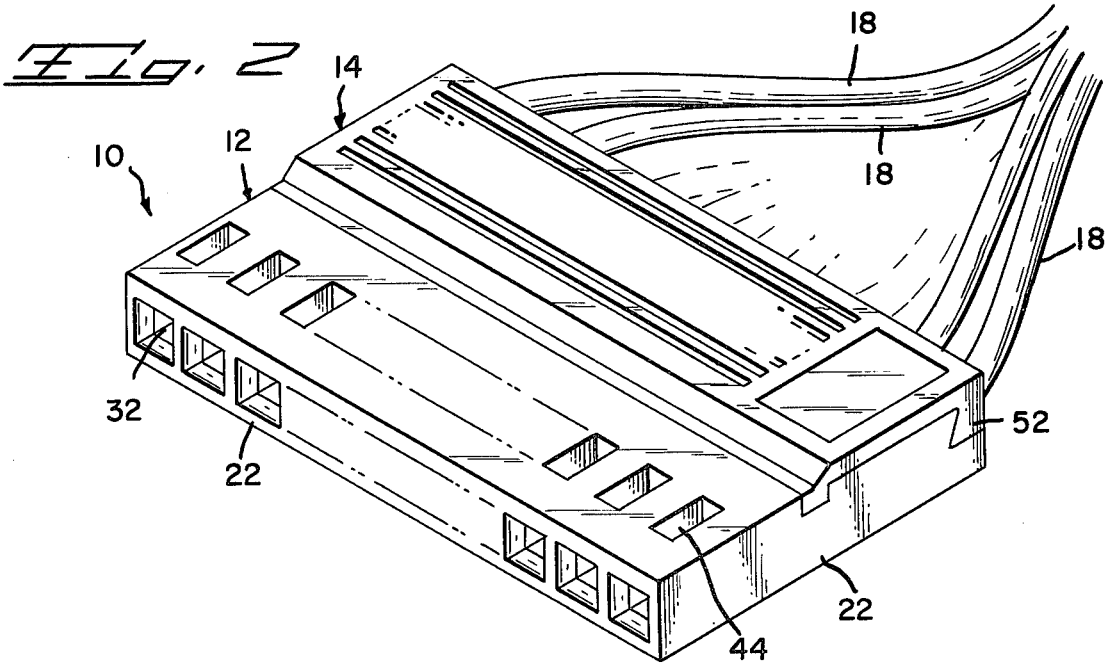
FIG. 2 is a perspective view of the fully assembled connector according to the present invention.
Figure 3:
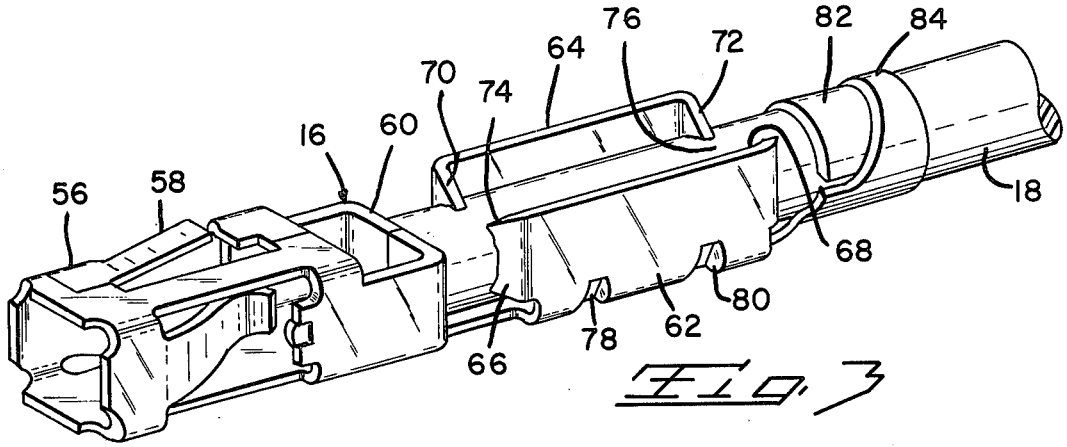
FIG. 3 is a perspective view of a terminal of the type used in the present invention.

The subject connector assembly 10 includes a housing 12, a mating cover 14, and a plurality of terminals 16 mounted in the housing for terminating respective conductors 18. The housing 12 is an elongated member of rigid insulative material having a mating face 20, a pair of spaced end walls 22, 24, side walls 26, 28 interconnecting the end walls and a plurality of intermediate walls 30 extending in parallel spaced relation between the side-walls 26, 28 to define therebetween a plurality of terminal passages 32. The side wall 26 is shorter than the side wall 28 so that each passage 32 is enclosed at the forward end, towards the mating face 20, and channel shaped towards the rear end. Each end wall 22, 24 has an inwardly directed flange 34, 36 and each intermediate wall 28 has flanges 38, 40. Each flange 34, 36, 38, 40 at least partially overhangs and encloses a portion of the channel shape of each passage 32. The rear of each end wall 22, 24 and each intermediate wall 28 has a stepped profile 42. The side wall 26 is provided with a plurality of apertures 44, each aligned with a respective passage and spaced rearwardly of the mating face 20. The side wall 28 is provided with a plurality of indexing recesses 46.

The cover 14 has a housing engaging front edge portion 48 with a plurality of tines 50 extending therefrom. Each tine is aligned to be received within the enclosed portion of a respective passage 32. The cover 14 further includes, along the rear edge thereof, a plurality of depending latch legs 52 each of which has a shoulder 54 directed toward the edge 48 to engage in a profiled portion 42 of the housing 12.

Each terminal 16 has a forward mating end 56, which is here shown as a pin receptacle of the type described in U.S. Pat. No. 3,363,224, the disclosure of which is incorporated herein by reference. This mating end includes an outwardly directed locking lance 58 and a rear closure or stop 60 which serves to both limit the penetration of a mating pin terminal into the receptacle as well as penetration of the conductor 18 into the receptacle. The terminal 16 further includes an insulation displacing rear portion formed by a pair of upstanding walls 62, 64 defining a channel therebetween. Each end of each wall has an inwardly directed end portion 66, 68, 70, 72 with the opposing pairs of end portions defining insulation piercing slots 74, 76 therebetween. Each side wall is provided with indents 78, 80 which provides strength to the side walls 62, 64 during termination operation. The terminal is completed by a pair of conductor insulation engaging ears 82, 84.

The subject connector assembly 10 is utilized by first pre-loading the housing 12 with a plurality of terminals 16. Each terminal has its forward mating end 56 extending into the enclosed portion of a respective passage with the lance 58 extending into the associated aperture 44 to secure the terminal in position. This leaves the channel-shaped rear portion of the terminal exposed in the open rear portion of each passage and secured therein by the flanges 34, 36, 38, 40 overlying the side walls 62, 64 of each respective terminal 16. Each conductor 18 can then be placed in an appropriate channel and terminated by a low force to drive the conductor into the slots 74, 76 defined by the inturned ends 66, 68, 70, 72. This insertion will make an effective insulation piercing contact of the conductor by the terminal to make a good mechanical and electrical engagement therebetween. This insertion force would also be utilized to bend the crimp ears 82, 84 inward to secure the conductor 18 in the respective terminal 16.

Figure 4:
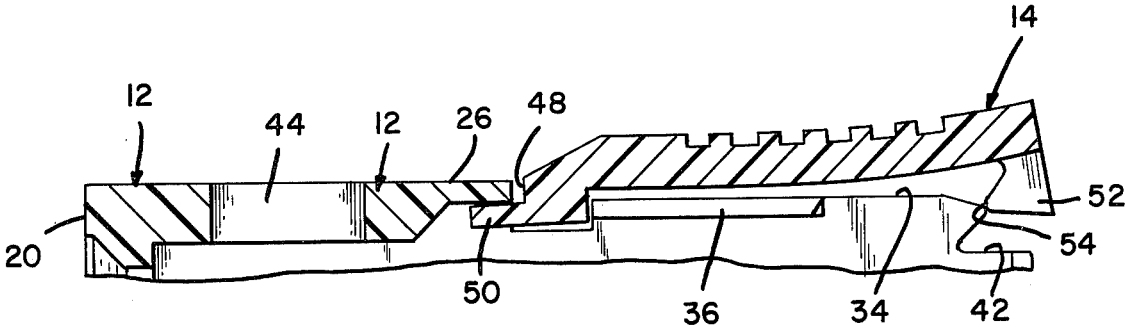
FIG. 4 is a longitudinal section through the upper half of the subject connector assembly showing the step of mating the cover with the housing.
Figure 5:
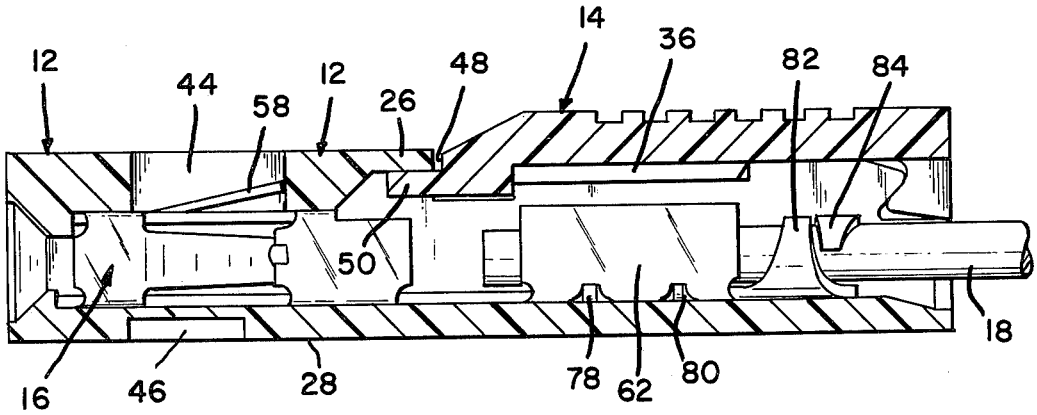
FIG. 5 is a longitudinal section through the fully assembled connector according to the present invention.
Figure 6:
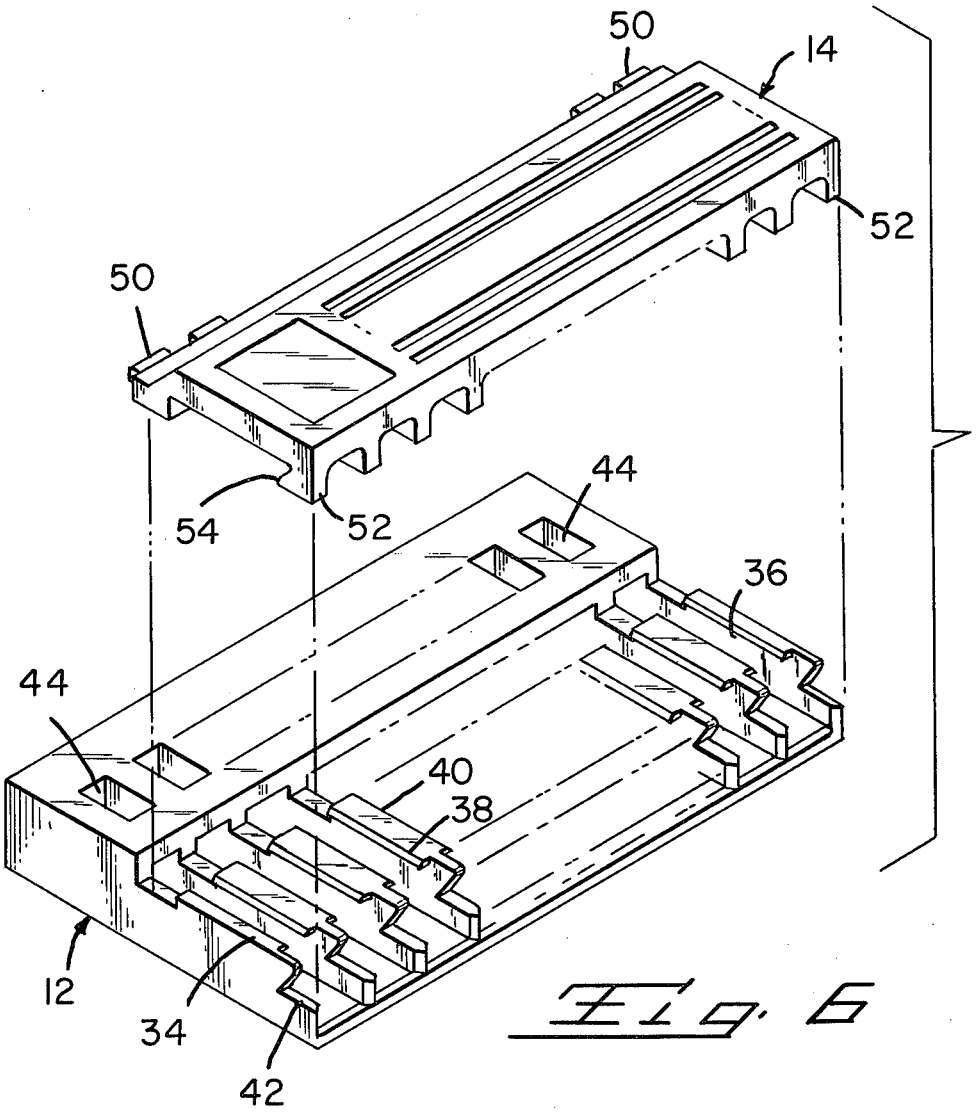
FIG. 6 is an exploded perspective view of the rear of the connector according to the present invention.
Figure 7:
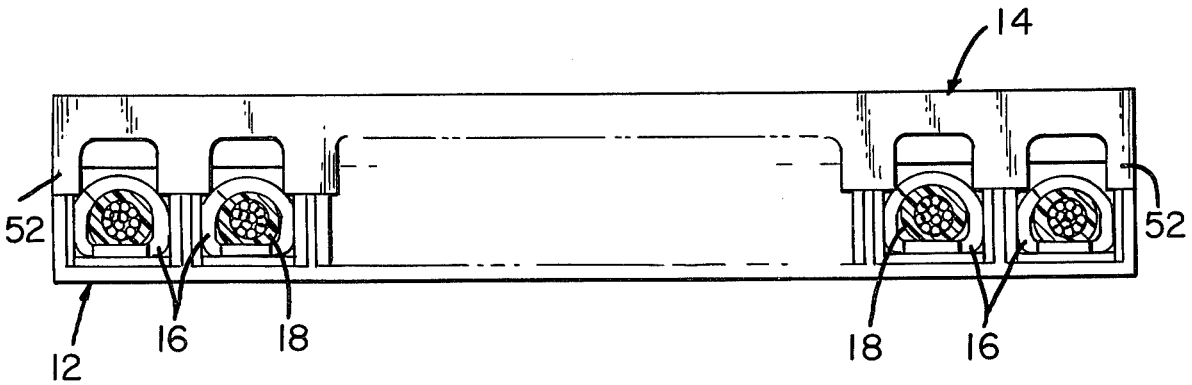
FIG. 7 is a rear elevation of the terminated and assembled connector according to the present invention.

The cover 14 is applied by inserting the tines 50 into the respective passages 32 and flexing the cover, as shown in FIG. 4, so that the legs 52 will allow shoulders 54 to pass over the profiles 42 and engage therewith, as best seen in FIG. 7. The legs will also serve, to a certain extent, to separate the individual conductors 18 in comb fashion.

The present invention may be subject to many modifications and changes without departing from the spirit or essential characteristics thereof. The present embodiment should therefore be considered in all respects as illustrative and not restrictive of the scope of the invention.

What is claimed is:

1. An electrical connector assembly comprising:

an elongated housing of rigid insulative material having a plurality of terminal passages extending in a single row from a rear end through said housing to open on a front mating face, each said passage being fully enclosed at the mating face and outwardly open channel shaped at the rear end remote from said mating face, said rear end having a stepped profile;

a plurality of terminals each mounted in a respective one of said passages, each said terminal having a forwardly directed mating portion lying in said fully enclosed portion of said passage and an insulation displacing rear portion lying in and accessible from said rear channel-shaped portion; and a cover having a forward end profiled to be received in said fully enclosed portions of said passages to hold said cover in assembly therewith and a plurality of depending rear legs each engageable with a respective portion of said rear stepped profile between each said passage and at both ends of said housing to hold said cover thereagainst while separating individual conductors leading thereto into alignment with respective passages, whereby terminals pre-loaded in said housing can be terminated by a low force insulation displacing movement and enclosed by application of said cover member.

2. An electrical connector assembly according to claim 1 further comprising:

a plurality of apertures in said housing, each said aperture opening into a respective passage; and each said terminal has a lance engageable in a respective aperture to secure said terminal in said passage.

3. An electrical connector assembly according to claim 2 further comprising:

an array of indexing recesses in said housing on the side opposite said apertures, said recesses enabling handling of said housing in termination tooling.

4. An electrical connector assembly comprising:

an elongated housing of rigid insulative material having a mating face, a pair of spaced end walls interconnected by a pair of spaced side walls, a plurality of parallel, spaced intermediate walls interconnecting said side walls and defining a plurality of parallel terminal passages opening on said mating face, said side walls being of different lengths so that said passage are fully enclosed toward said mating face and channel shaped toward the opposite end, each said end wall and each said intermediate wall having a profiled rear edge;

a plurality of terminals each mounted in a respective one of said passages, each said terminal having a forwardly directed mating portion lying in said fully enclosed portion of said passage and an insulation displacing rear portion lying in and accessible from said rear channel-shaped portion; and a cover having a forward end profiled to be received in said fully enclosed portions of said passages to hold said cover in assembly therewith and a plurality of depending rear legs each engageable with a respective one of said profiled rear edges of said end and said intermediate walls to hold said cover thereagainst while separating individual conductors leading thereto, whereby terminals pre-loaded in said housing can be terminated by a low force insulation displacing movement and enclosed by application of said cover.

5. An electrical connector assembly according to claim 4 wherein:

said housing further comprises a plurality of apertures in one side wall, each said aperture opening into a respective passage; and each said terminal has a locking lance engageable in said aperture of the respective passage.

6. An electrical connector assembly according to claim 5 wherein:

the other said side wall has a plurality of regularly spaced indexing recesses whereby said housing can be sequenced through insertion machinery.

7. An electrical connector assembly according to claim 4 wherein said cover has limited flexibility enabling assembly with said housing.

8. An electrical connector assembly according to claim 4 further comprising a pair of flanges on each said intermediate wall and an inwardly directed flange on each said end wall, said flanges partially overlying respective channel shaped portions of said passages to retain said terminals therein.

* * * * *